US008948631B2

(12) United States Patent
Honda

(10) Patent No.: US 8,948,631 B2
(45) Date of Patent: Feb. 3, 2015

(54) IMAGE FORMING APPARATUS AND DENSITY ADJUSTING METHOD

(75) Inventor: Takahiro Honda, Osaka (JP)

(73) Assignee: Kyocera Mita Corporation, Osaka-shi (JP)

( * ) Notice: Subject to any disclaimer, the term of this patent is extended or adjusted under 35 U.S.C. 154(b) by 190 days.

(21) Appl. No.: 13/091,188

(22) Filed: Apr. 21, 2011

(65) Prior Publication Data

US 2011/0268462 A1 Nov. 3, 2011

(30) Foreign Application Priority Data

Apr. 28, 2010 (JP) ..... 2010-103428

(51) Int. Cl.
*G03G 15/00* (2006.01)
*G03G 15/01* (2006.01)

(52) U.S. Cl.
CPC ..... *G03G 15/0178* (2013.01); *G03G 15/0131* (2013.01); *G03G 15/5058* (2013.01); *G03G 2215/00059* (2013.01)
USPC ..... 399/49

(58) Field of Classification Search
USPC ..... 399/49, 302
See application file for complete search history.

(56) References Cited

U.S. PATENT DOCUMENTS

2004/0141765 A1 7/2004 Shimura et al.
2006/0204261 A1 9/2006 Shimura et al.

FOREIGN PATENT DOCUMENTS

JP 11038707 A * 2/1999
JP 2002-229296 8/2002
JP 2006130779 A * 5/2006
JP 2007140545 6/2007
JP 2007249032 9/2007

OTHER PUBLICATIONS

Matsushiro (JP 11-038707 A; Feb. 1999) JPO Machine Translation.*
Hiraguchi et al. (JP 2007-249032 A), Dec. 2007, JPO Computer Translation.*

* cited by examiner

*Primary Examiner* — Erika J Villaluna
(74) *Attorney, Agent, or Firm* — Gerald E. Hespos; Michael J. Porco; Matthew T. Hespos

(57) ABSTRACT

An image forming apparatus has a memory, an image forming unit, an intermediate transfer member, a density detector, a background density measurer, a test patch controlling unit and a density correcting unit. The density detector detects the density of the intermediate transfer member. The background density measurer stores background density, in the memory in correspondence with position information on the intermediate transfer member at a predetermined timing before a calibration for adjusting image formation density. The test patch controlling unit causes the image forming unit to form a test patch, on the intermediate transfer member while the intermediate transfer member is driven at a predetermined speed. The density correcting unit executes the calibration to adjust image formation density according to a difference between the background density stored in the memory when executing the calibration and corresponding to the position and density of the test patch.

3 Claims, 6 Drawing Sheets

FIG. 4

| POSITION INFORMATION (Vx × ELAPSED TIME) | BACKGROUND DENSITY | |
|---|---|---|
| | +Y SIDE | −Y SIDE |
| Xm1 | Dxm1 | Dxm1 |
| Xc1 | Dxc1 | Dxc1 |
| Xy1 | Dxy1 | Dxy1 |
| Xk1 | Dxk1 | Dxk1 |
| Xm2 | Dxm2 | Dxm2 |
| Xc2 | Dxc2 | Dxc2 |
| Xy2 | Dxy2 | Dxy2 |
| Xk2 | Dxk2 | Dxk2 |
| Xm3 | Dxm3 | Dxm3 |
| Xc3 | Dxc3 | Dxc3 |
| Xy3 | Dxy3 | Dxy3 |
| Xk3 | Dxk3 | Dxk3 |
| Xm4 | Dxm4 | Dxm4 |
| Xc4 | Dxc4 | Dxc4 |
| Xy4 | Dxy4 | Dxy4 |
| Xk4 | Dxk4 | Dxk4 |

IMAGE FORMING APPARATUS AND DENSITY ADJUSTING METHOD

BACKGROUND OF THE INVENTION

1. Field of the Invention

The present invention relates to an image forming apparatus such as a copier, a multifunction peripheral, a printer or a facsimile machine and particularly to a technology for a calibration process.

2. Description of the Related Art

Conventionally in electrophotographic image forming apparatuses, image quality is ensured by executing a calibration process for forming test patches for image density adjustment on a surface of an intermediate transfer belt, detecting the densities of the test patches, adjusting density by adjusting a developing bias voltage, a conversion table for print data and the like based on the densities of the test patches.

For example, there is known a technology for detecting the densities of image patches formed on the transfer belt by an optical sensor and adjusting image density by adjusting a developing bias voltage based on the detected densities of the image patches.

In such a calibration process, it is necessary to measure the densities of test patches formed on the intermediate transfer belt and the densities at positions of the intermediate transfer belt where the test patches are to be formed, but not yet formed (background densities) and calculate differences between the former and latter measurement values to eliminate influences such as the luminance of the intermediate transfer belt in a state where no image is formed for accurate calculation of the densities of the test patches formed on the intermediate transfer belt.

SUMMARY OF THE INVENTION

Accordingly, the present invention is a further improvement of the above prior art.

Specifically, the present invention is directed to an image forming apparatus, comprising a memory unit, an image forming unit, an intermediate transfer member, a density detecting unit, a background density measuring unit, a test patch formation controlling unit and a density correcting unit.

The image forming unit forms a toner image.

The toner image formed by the image forming unit is transferred to the intermediate transfer member and secondarily transferred from the intermediate transfer member to a recording medium.

The density detecting unit detects the density of a surface of the intermediate transfer member.

The background density measuring unit stores background density, which is density of the intermediate transfer member surface detected by the density detecting unit in a state where the toner image is not transferred, in the memory unit in correspondence with position information on the intermediate transfer member surface at a predetermined timing before an execution timing of a calibration process for adjusting image formation density separately from the calibration process.

The test patch formation controlling unit causes the image forming unit to form a test patch, which is a toner image for density adjustment, on the intermediate transfer member surface while causing the intermediate transfer member to drive at a predetermined driving speed.

The density correcting unit executes the calibration process to adjust image formation density by the image forming unit according to a difference between the background density already stored in the memory unit by the background density measuring unit at the time of executing the calibration process and corresponding to the position information indicating the formation position of the test patch on the intermediate transfer member surface and the density of the test patch formed on the intermediate transfer member surface by the test patch formation controlling unit and detected by the density detecting unit at the time of executing the calibration process when the calibration process is executed.

These and other objects, features and advantages of the present invention will become more apparent upon reading the following detailed description along with the accompanying drawings.

BRIEF DESCRIPTION OF THE DRAWINGS

FIG. 4 is a table showing an example of storage of background densities, which are densities of an intermediate transfer belt surface, in a memory unit in correspondence with position information on the intermediate transfer belt surface by a background density measuring section.

DESCRIPTION OF THE PREFERRED EMBODIMENTS

Figure 1:
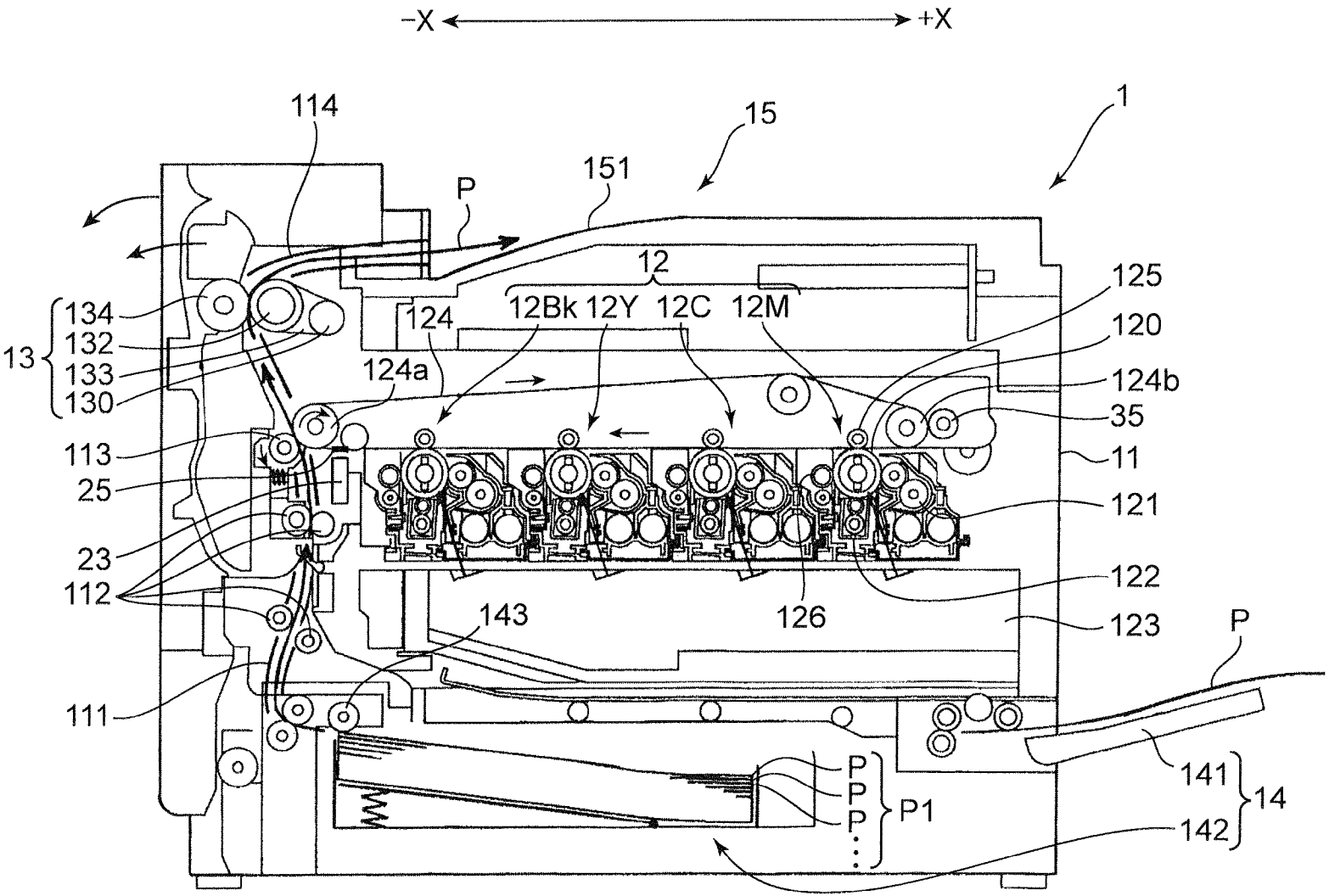
FIG. 1 is a sectional view of a printer as an example of an image forming apparatus according to the invention.

An internal structure of a printer 1 as an example of an image forming apparatus according to the present invention is outlined with reference to FIG. 1. Note that, in FIG. 1, a lateral direction on the plane of FIG. 1 is referred to as a lateral direction, depth directions with respect to the plane of FIG. 1 are referred to as forward and backward directions. Particularly, a −X direction of FIG. 1 is referred to as a leftward direction, a +X direction as a rightward direction, a forward direction from the plane of FIG. 1 as a forward direction and a backward direction from the plane of FIG. 1 as a backward direction.

As shown in FIG. 1, the printer 1 includes a box-shaped apparatus main body 11. An image forming unit 12 for forming an image based on image data transmitted from an external apparatus such as a network-connected computer, a fixing unit 13 for executing a fixing process on an image formed by the image forming unit 12 and transferred to a recording sheet P, and a sheet storage unit 14 for storing recording sheets for image transfer are provided in the apparatus main body 11. A sheet discharge unit 15, to which a recording sheet P after the fixing process is discharged, is formed in a top part of the apparatus main body 11.

An unillustrated operation unit used to enter output conditions of a recording sheet P is provided on the left side of the top part of the apparatus main body 11. This operation panel includes a power key, a start button and various keys for entering output conditions such as selective setting of a normal image forming mode in which a normal image forming operation is performed and a toner suppression mode in which a toner consumption amount required for an image forming operation based on the same image data is suppressed as compared with the normal image forming mode. A display (not shown) is provided on the operation panel to display operating conditions and states of the printer 1. Note that the operation panel and the display are provided in an operation unit 127 (FIG. 3) as described later.

The image forming unit 12 is for forming a toner image on a recording sheet P fed from the sheet storage unit 14. In this embodiment, the image forming unit 12 includes a magenta unit 12M using magenta toner, a cyan unit 12C using cyan toner, a yellow unit 12Y using yellow toner and a black unit 12Bk using black toner, the units 12M to 12Bk being successively arranged from an upstream side to a downstream side (from a right side to a left side).

Each of the units 12M, 12C, 12Y and 12Bk includes a photoconductive drum 120 and a developing unit 121. The photoconductive drum 120 is for forming an electrostatic latent image and a toner image in conformity with the electrostatic latent image on a circumferential surface, and an amorphous silicon layer is laminated on the circumferential surface. The photoconductive drum 120 of each unit receives supply of the toner from the developing unit 121 while being rotated in a counterclockwise direction in FIG. 1.

Chargers 122 are arranged at positions right below the respective photoconductive drums 120 and exposure units 123 are arranged below the respective chargers 122.

The respective photoconductive drums 120 have the circumferential surfaces thereof uniformly charged by the corresponding chargers 122 and the charged circumferential surfaces of the photoconductive drums 120 are irradiated with laser beams corresponding to the respective colors and based on image data input from the computer or the like by the respective exposure units 123. In this way, electric charges in parts irradiated with the laser beams are eliminated according to the intensities of the laser beams (exposure amounts), whereby electrostatic latent images are formed on the circumferential surfaces of the respective photoconductive drums 120.

Each developing unit 121 supplies the toner from an unillustrated toner container containing the toner to an unillustrated developing roller and applies a predetermined developing bias voltage to the developing roller. Since a potential difference is created between the photoconductive drum 120 and the developing roller at this time, the toner adhering to the developing roller transfers toward the circumferential surface of the photoconductive drum 120. In this way, the toner is supplied to the electrostatic latent image formed on the circumferential surface of the photoconductive drum 120 to form a toner image on the circumferential surface of the photoconductive drum 120.

An intermediate transfer belt 124 as an intermediate transfer member according to the present invention mounted between a drive roller 124*a* and a driven roller 124*b* is disposed above the photoconductive drums 120. This intermediate transfer belt 124 is disposed in contact with the respective photoconductive drums 120.

The intermediate transfer belt 124 rotates at a predetermined driving speed (endless rotation) between the drive roller 124*a* and the driven roller 124*b* in synchronization with the respective photoconductive drums 120 while being pressed against the circumferential surfaces of the photoconductive drums 120 by primary transfer rollers 125 disposed in correspondence with the respective photoconductive drums 120.

When the intermediate transfer belt 124 rotates, a magenta toner image on the photoconductive drum 120 of the magenta unit 12M is transferred to a surface of the intermediate transfer belt 124, then a cyan toner image on the photoconductive drum 120 of the cyan unit 12C is transferred at the same position of the intermediate transfer belt 124 in a superimposition manner, then a yellow toner image on the photoconductive drum 120 of the yellow unit 12Y is transferred at the same position of the intermediate transfer belt 124 in a superimposition manner and finally a black toner image on the photoconductive drum 120 of the black unit 12Bk is transferred at the same position of the intermediate transfer belt 124 in a superimposition manner by the respective primary transfer rollers 125. In this way, a full color toner image is formed on the surface of the intermediate transfer belt 124.

The toner image formed on the surface of the intermediate transfer belt 124 is transferred to a recording sheet P conveyed from the sheet storage unit 14.

Specifically, a secondary transfer roller 113 is disposed in contact with the circumferential surface of the intermediate transfer belt 124 at a position facing the drive roller 124*a* of the intermediate transfer belt 124. A vertically extending sheet conveyance path 111 is formed in a nip portion between the drive roller 124*a* and the secondary transfer roller 113 with the intermediate transfer belt 124 sandwiched.

Pairs of conveyor rollers 112 are disposed in this sheet conveyance path 111 so that a recording sheet P from the sheet storage unit 14 is conveyed toward the nip portion between the intermediate transfer belt 124 and the secondary transfer roller 113 by driving the pairs of the conveyor rollers 112.

In the nip portion between the intermediate transfer belt 124 and the secondary transfer roller 113 in the sheet conveyance path 111, the recording sheet P being conveyed in the sheet conveyance path 111 is pressed between the intermediate transfer belt 124 and the secondary transfer roller 113 and a toner image on the intermediate transfer belt 124 is transferred (secondary transfer) to the recording sheet P by a transfer bias of the secondary transfer roller 113.

The fixing unit 13 is for executing the fixing process to fix the toner image secondarily transferred to the recording sheet P in the nip portion between the intermediate transfer belt 124 and the secondary transfer roller 113 to the recording sheet P.

The fixing unit 13 includes a heat roller 132 internally provided with an electric heating element (fixing heater) as a heat source, a fixing roller 130 arranged to face this heat roller 132, a fixing belt 133 mounted between the fixing roller 130 and the heat roller 132 and a pressure roller 134 arranged to face the heat roller 132 via this fixing belt 133.

The recording sheet P fed to the fixing unit 13 with the toner image transferred thereto receives heat from the heat roller 132 while passing between the pressure roller 134 and the fixing belt 133 having a high temperature, whereby the fixing process is executed. The recording sheet P finished with the fixing process is discharged to a discharge tray 151 of the sheet discharge unit 15 provided in the top part of the apparatus main body 11 via a discharge conveyance path 114 extending from an upper part of the fixing unit 13.

The sheet storage unit 14 includes a manual feed tray 141 openably and closably provided on the right wall of the apparatus main body 11 and a sheet tray 142 detachably mounted at a position below the exposure units 123 in the apparatus main body 11. A stack of sheets is stored in the sheet tray 142.

The sheet tray 142 has a box body with an entirely open upper surface and can store a sheet stack P1 made up of a plurality of recording sheets P stacked one on another. The uppermost recording sheet P of the sheet stack P1 stored in the sheet tray 142 is fed toward the sheet conveyance path 111 from the sheet stack P1 by driving a pickup roller 143 held in contact with the upper surface of the left end of this sheet P. The recording sheet P is fed one by one toward the nip portion between the secondary transfer roller 113 and the intermediate transfer belt 124 in the image forming unit 12 via the sheet conveyance path 111 by driving the pairs of conveyor rollers 112.

Toner density detection sensors 23 are disposed at positions upstream (to the right) of the nip portion between the secondary transfer roller 113 and the intermediate transfer belt 124 in a running direction of the intermediate transfer belt 124 and facing the circumferential surface of the intermediate transfer belt 124.

The toner density detection sensors 23 are sensors for detecting the toner density of the surface of the intermediate transfer belt 124. The toner density detection sensors 23 emit a predetermined amount of light toward the surface of the intermediate transfer belt 124 and output electrical signals (voltage values) in proportion to the amount of reflected light to a density detecting section 101 (FIG. 3) to be described later as a drive controller of the toner density detection sensors 23.

Figure 2:
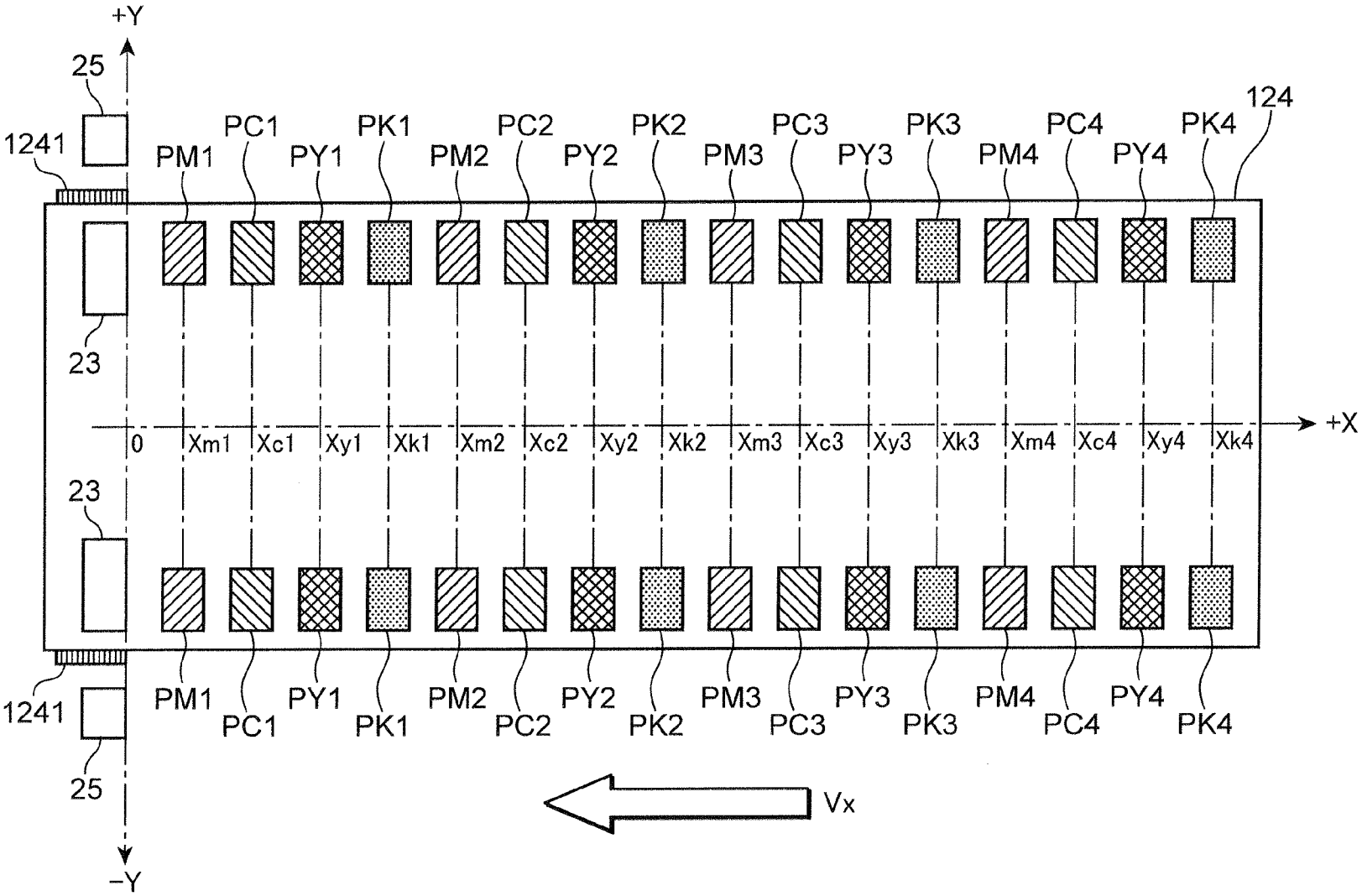
FIG. 2 is a schematic diagram showing an intermediate transfer belt having test patches for density correction formed thereon.

For example, as shown in FIGS. 1 and 2, the toner density detection sensors 23 are arranged at two different positions in a longitudinal direction (+Y-Y direction in FIG. 2) of the drive roller 124*a* of the intermediate transfer belt 124. However, the number and arrangement positions of the toner density detection sensors 23 are not limited to these.

Further, position detecting members 1241 are provided on the opposite side surfaces of the intermediate transfer belt 124 in the longitudinal direction (+Y-Y direction in FIG. 2) of the drive roller 124*a* and position detecting member detection sensors 25 are provided at outer sides (+Y-Y direction in FIG. 2) of the position detecting members 1241.

The position detecting member detection sensors 25 are sensors for detecting passage of the position detecting members 1241. The position detecting member detection sensors 25 emit a predetermined amount of light toward the side surfaces of the intermediate transfer belt 124 rotated at a predetermined driving speed and output electrical signals (voltage values) in proportion to the amount of reflected light to a member position detecting section 102 (FIG. 3) as a drive controller of the position detecting member detection sensors 25.

Further, a cleaning roller (cleaning unit) 35 for removing the toner on the intermediate transfer belt 124 is disposed at a position facing the driven roller 124*b* with the intermediate transfer belt 124 located therebetween.

Figure 3:
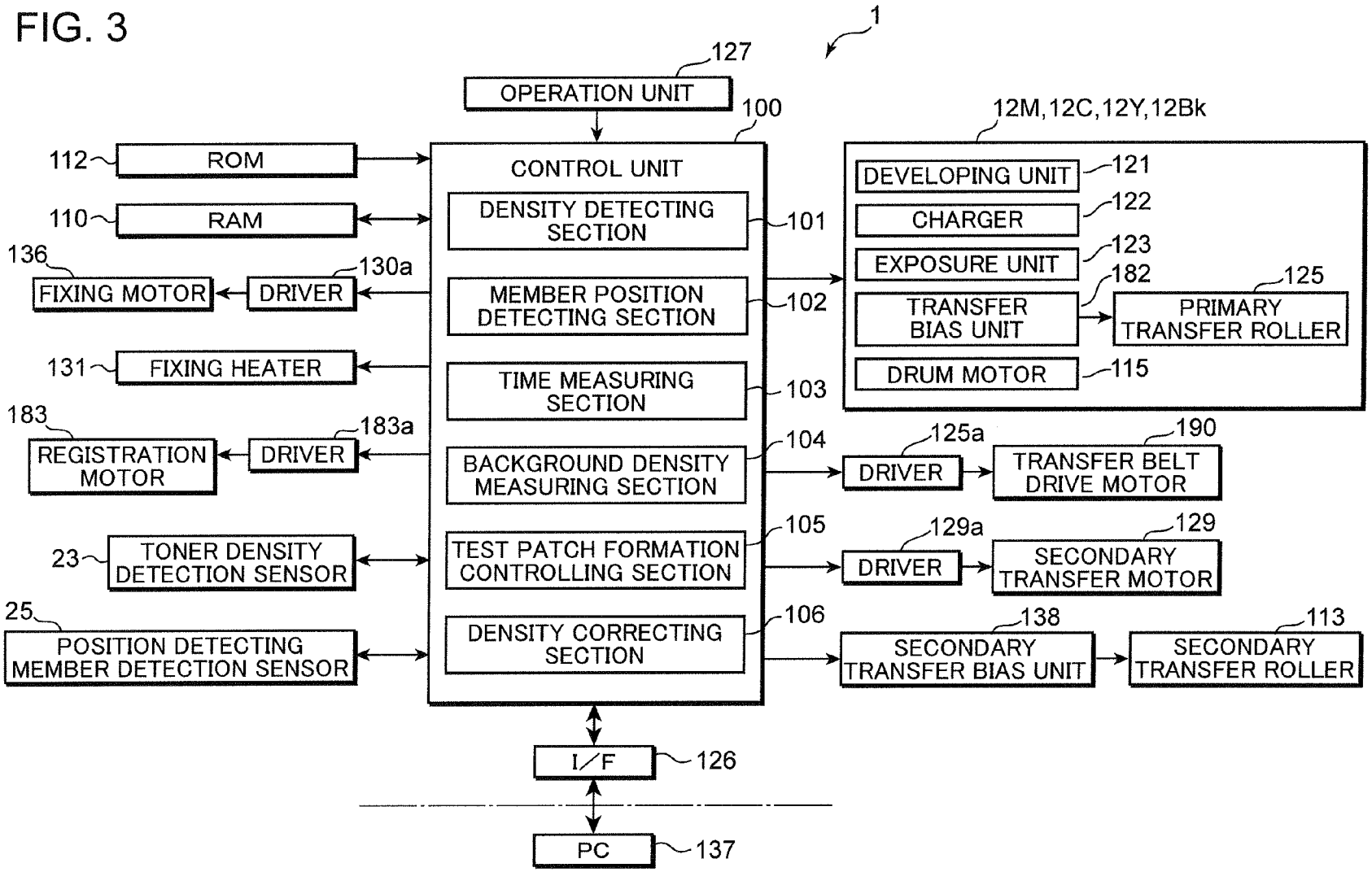
FIG. 3 is a block diagram showing an exemplary electrical construction of the printer.

FIG. 3 is a block diagram showing an exemplary schematic construction of the printer 1. The printer 1 includes a control unit 100 responsible for the control of the entire printer 1.

To the control unit 100 are connected a ROM 112, as a memory unit according to the present invention, storing operation programs of the entire apparatus such as an image formation control program, a RAM 110 which temporarily stores image data and the like and functions as a work area, an unillustrated nonvolatile memory for storing set values of the respective parts and image data, etc.

The control unit 100 includes an unillustrated CPU, which implements the operation programs such as the image formation control program stored in the ROM 112 to control the entire apparatus.

The above image generating units 12M, 12C, 12Y and 12Bk of the respective colors are also connected to the control unit 100. The control unit 100 controls the charger 122, the exposure unit 123, the developing unit 121, a transfer bias unit 182 and a drive motor 115 of each of the image generating units 12M, 12C, 12Y and 12Bk. The transfer bias unit 182 applies a transfer bias to the primary transfer roller 125 to transfer a toner image on the photoconductive drum 120 to a recording sheet P. The drive motor 115 serves as a drive source of the photoconductive drum 120.

Although the respective image generating units of magenta, cyan, yellow and black are shown as one image generating unit in FIG. 3, the image generating units of the respective colors are actually connected to and controlled by the control unit 100.

The above toner density detection sensors 23 and position detecting member detection sensors 25 are also connected to the control unit 100 and detection signals (output voltages) of the respective sensors are input to the control unit 100.

A fixing motor 136 is for driving and rotating the heat roller 132 and the pressure roller 134 (FIG. 1) and controlled by the control unit 100 via a driver 130*a*. A fixing heater 131 is provided in the heat roller 132 (FIG. 1) and on/off controlled by the control unit 100.

A transfer belt drive motor 190 is a drive source for the drive roller 124*a* for causing the intermediate transfer belt 124 to run at the predetermined driving speed, and controlled by the control unit 100 via a driver 125*a*.

The operation unit 127 includes the operation panel used to enter various operation instructions from a user and the display. The control unit 100 is connected to a PC (personal computer) 137 via an interface 126. The printer 1 forms an image based on image data input from this PC 137.

A registration motor 183 is for driving and rotating unillustrated registration rollers and controlled by the control unit 100 via a driver 183*a*.

A secondary transfer motor 129 is for driving and rotating the secondary transfer roller 113 (FIG. 1) and controlled by the control unit 100 via a driver 129*a*.

Further, a secondary transfer bias unit 138 for applying a transfer bias to the secondary transfer roller 113 is connected to the control unit 100.

The control unit 100 also functions as a density detecting section 101, a member position detecting section 102, a time measuring section 103, a background density measuring section 104, a test patch formation controlling section 105 and a density correcting section 106.

The density detecting section 101 calculates the toner density of the surface of the intermediate transfer belt 124 based on voltage values indicated by output signals of the toner density detection sensors 23. In other words, a density detecting unit according to the present invention is constituted by the toner density detection sensors 23 and the density detecting section 101.

The member position detecting section 102 detects the passage of the position detecting members 1241 based on sudden changes in voltage values indicated by output signals of the position detecting member detection sensors 25 when the position detecting members 1241 rotating at the predetermined driving speed together with the intermediate transfer belt 124 pass ahead of the position detecting member detection sensors 25. In other words, a member position detecting unit according to the present invention is constituted by the position detecting member detection sensors 25 and the member position detecting section 102.

The time measuring section 103 measures a driving time of the intermediate transfer belt 124 after the detection of the passage of the position detecting members 1241 by the member position detecting section 102, i.e. a driving time of the transfer belt drive motor 190 from a point of time at which the position detecting members 1241 are detected by the member position detecting section 102, for example, by means of a timer or the like and stores this measurement value in the RAM 110.

The background density measuring section 104 stores background density, which is the density of the surface of the intermediate transfer belt 124 detected by the toner density detection sensors 23 and the density detecting section 101 in a state where no toner image is transferred to the surface of the intermediate transfer belt 124, in the RAM 110 in correspondence with position information on the surface of the intermediate transfer belt 124.

For example, as shown in FIGS. 2 and 4, when densities (background densities) DXm1 to DXk4 at positions Xm1 to Xk4 in a rotating direction (direction of arrow in FIG. 2) of the intermediate transfer belt 124 are detected by the toner density detection sensors 23 and the density detecting section 101, the background density measuring section 104 stores them in the RAM 110 in correspondence with position information Xm1 to Xk4 on the surface of the intermediate transfer belt 124.

Here, the background density measuring section 104 calculates multiplication results of the driving time of the intermediate transfer belt 124 (driving time of the transfer belt drive motor 190) measured by the time measuring section 103 after the detection of the passage of the position detecting members 1241 by the position detecting member detection sensors 25 and the member position detecting sections 102 and a predetermined driving speed Vx of the intermediate transfer belt 124 as the position information Xm1 to Xk4.

Although the background density measuring section 104 is described to store the background densities in the RAM 110, the background densities may be stored in the ROM 112 as the memory unit according to the present invention or an unillustrated nonvolatile memory without being limited to storage in the RAM 110.

The test patch formation controlling section 105 causes the image generating units 12M, 12C, 12Y and 12Bk of the respective colors to form test patches on the intermediate transfer belt 124 while the test patch formation controlling section 105 causes the intermediate transfer belt 124 to drive at the predetermined driving speed.

Specifically, the test patch formation controlling section 105 causes the image generating units 12M, 12C, 12Y and 12Bk of the respective colors to form toner images as test patches on the circumferential surfaces of the photoconductive drums 120 while changing developing bias voltages applied to the developing rollers provided in the respective units from a lower limit value to an upper limit value allowable in the developing units 121 in several steps (e.g. in four steps).

Subsequently, the test patch formation controlling section 105 causes the primary transfer rollers 125 to transfer the toner images to the intermediate transfer belt 124 while controlling to drive the transfer belt drive motor 190 and driving the intermediate transfer belt 124 at the predetermined driving speed, and stores the respective developing bias voltage values after changes in the RAM 110.

For example, as shown in FIG. 2, the test patch formation controlling section 105 causes test patches PM1 to 4, PC1 to 4, PY1 to 4, PK1 to 4 to be formed on the surface of the intermediate transfer belt 124 and store the developing bias voltage values at the time of forming the test patches PM1 to 4, PC1 to 4, PY1 to 4, PK1 to 4 in the RAM 110.

The density correcting section 106 executes a calibration process for adjusting image formation density by the image forming unit 12 according to differences between the densities of the test patches detected by the density detecting section 101 and the background densities corresponding to the position information on the formation positions of the test patches on the surface of the intermediate transfer belt 124 and stored in the RAM 110 (memory unit).

For example, as the calibration process, the density correcting section 106 adjusts control parameters of the developing units 121 so that the densities of toner images formed by the developing units 121 reach a target density set in the ROM 112, the nonvolatile memory or the like.

Note that the target density mentioned here means image density which is optimal in quality when an image forming operation is performed with new toners in the printer 1 that is not used even once. This target density is determined for every type of the printer 1 and stored in the ROM 112 or the nonvolatile memory beforehand at the time of shipment from a factory of the printer 1.

A specific example of the calibration process is described with reference to FIG. 2. When the toner densities of the respective test patches PM1 to 4, PC1 to 4, PY1 to 4, PK1 to 4 formed on the surface of the intermediate transfer belt 124 are respectively detected by the toner density detection sensors 23 and the density detecting section 101, the density correcting section 106 calculates the position information of the respective test patches PM1 to 4, PC1 to 4, PY1 to 4, PK1 to 4 by multiplying the driving time of the intermediate transfer belt 124 (driving time of the transfer belt drive motor 190) after the detection of the passage of the position detecting members 1241 by the position detecting member detection sensors 25 and the member position detecting sections 102 and the driving speed Vx of the intermediate transfer belt 124.

Subsequently, the density correcting section 106 obtains the background densities corresponding to the calculated position information of the respective test patches and calculates differences between the toner densities of the respective test patches PM1 to 4, PC1 to 4, PY1 to 4, PK1 to 4 detected by the toner density detection sensors 23 and the density detecting section 101 and the density values indicating the background densities corresponding to these test patches.

For example, the density correcting section 106 calculates the differences by subtracting the density values indicating the background densities corresponding to the test patches from the density values indicating the toner densities of the respective test patches PM1 to 4, PC1 to 4, PY1 to 4 and PK1 to 4.

Note that the difference calculation method is not limited to this. For example, if the magnitudes of the density values are in a relationship contrary to the above example due to the magnetic properties of the toners, the differences may be calculated by adding the density values indicating the toner densities of the respective test patches PM1 to 4, PC1 to 4, PY1 to 4, PK1 to 4 and the density values indicating the background densities corresponding to these test patches. Any calculation method may be employed so long as the densities (background densities) at the positions on the intermediate transfer belt 124 where the test patches are to be formed are eliminated from the toner densities of the respective test patches PM1 to 4, PC1 to 4, PY1 to 4, PK1 to 4.

Subsequently, the density correcting section 106 stores combinations of the calculated difference values between the densities of the respective test patches and the background densities and the developing bias voltage values stored in the RAM 110 at the time of forming the respective test patches PM1 to 4, PC1 to 4, PY1 to 4, PK1 to 4 in the RAM 110.

Figure 5:
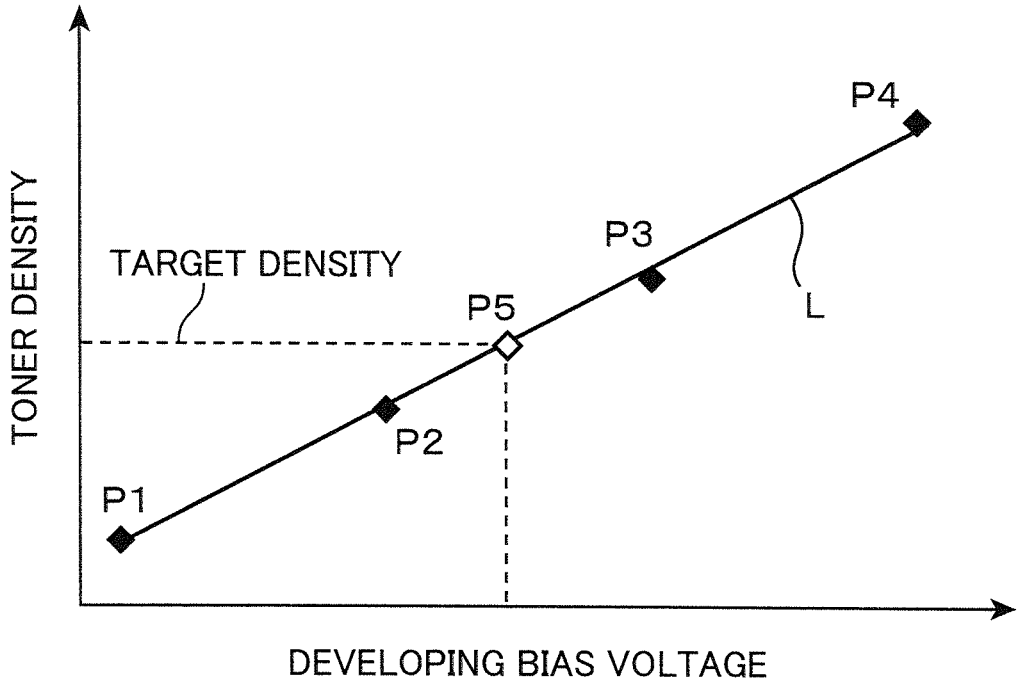
FIG. 5 is a graph showing an example of adjustment of a developing bias voltage by a calibration process.

Subsequently, as shown in FIG. 5, the density correcting section 106 plots points P1 to P4 corresponding to the combinations of the developing bias voltage values and the difference values between the toner densities and the background densities at the formation positions of the test patches stored in the RAM 110 in a two-dimensional coordinate system with a horizontal axis representing the developing bias voltages and a vertical axis representing the difference values between the toner densities and the background densities at the formation positions of the test patches, and calculates an approximation line L minimizing the square sum of distances from the respective points P1 to P4, for example, by a specified calculation method such as linear regression.

Subsequently, the density correcting section 106 obtains a developing bias voltage value (developing bias voltage value at point P5 in FIG. 5) corresponding to the target density set in the RAM 110 beforehand based on the calculated approximation line L and sets the obtained developing bias voltage value as a developing bias voltage value at the time of an image forming operation by the developing unit 121.

Here, if the developing bias voltage value set by the density correcting section 106 is below the lower limit value allowable in the developing unit 121 or above the upper limit value allowable in the developing unit 121, the lower limit value or the upper limit value is set as the developing bias voltage value at the time of an image forming operation by the developing unit 121. The density correcting section 106 executes the adjustment of the developing bias voltage for respective the image generating units 12C, 12M and 12Y.

Note that the density correcting section 106 also adjusts the developing bias voltage values for the other image generating units similar to the adjustment of the developing bias voltage value in the above image generating unit 12Bk, in case the density correcting section 106 adjusts the developing bias voltage values of the image generating unit 12Bk first.

Figure 6:
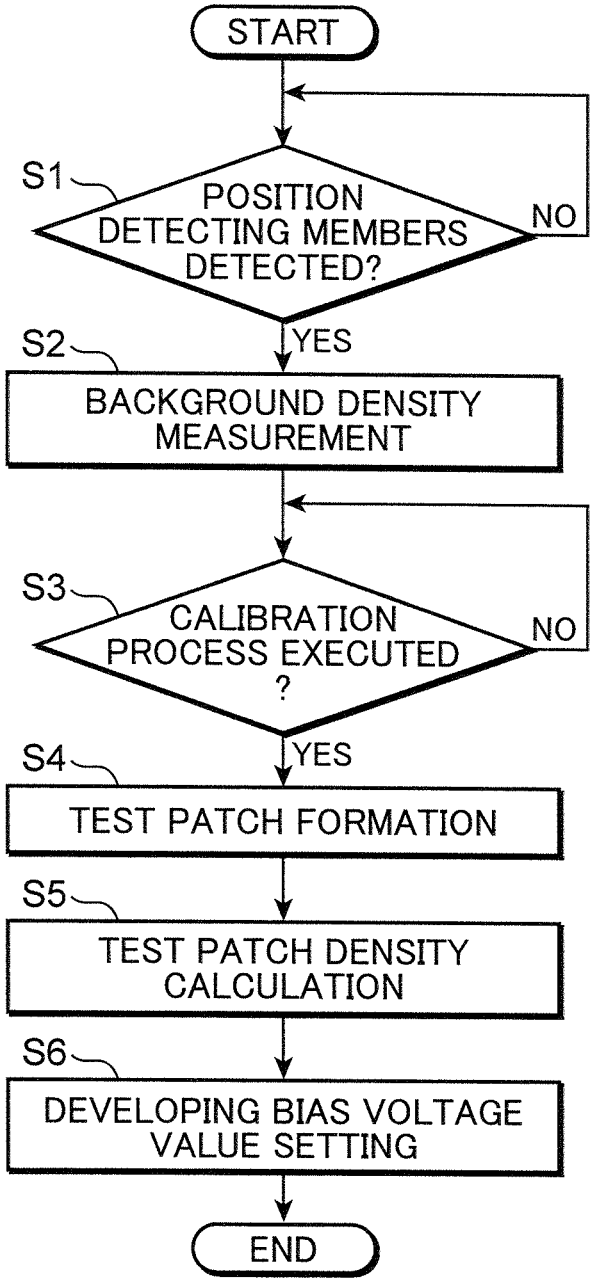
FIG. 6 is a flow chart showing an exemplary flow of the calibration process.

Next, the flow of the calibration process is described with reference to FIG. 6. Note that the calibration performed in the image generating unit 12Bk is described below since a process similar to that of the image generating unit 12Bk is also executed in the image generating units 12C, 12M and 12Y.

It is described below that a density correcting process by the density correcting section 106 is regularly executed after the elapse of a predetermined time or after a predetermined number of sheets are printed. However, the execution timing of the density correcting process is not limited to this and, for example, may be a timing when the printer 1 is turned on or when an instruction to execute the calibration process is received from the operation panel and may be appropriately changed as a design matter.

When the printer 1 is turned on, the control unit 100 reads the target density stored in the ROM 112 and sets it in the RAM 110 and starts an initialization process such as driving of the intermediate transfer belt 124 at the predetermined driving speed Vx (FIG. 2).

Subsequently, the toner density detection sensors 23 and the density detecting section 101 start detecting the densities of the surface of the intermediate transfer belt 124 (background densities) and, simultaneously, the member position detecting section 102 starts detecting the member position detecting section 1241 provided on the side surfaces of the intermediate transfer belt 124. When the member position detecting sections 1241 are detected by the member position detecting section 102 (S1; YES), the background density measuring section 104 calculates the position information on the intermediate transfer belt 124 using the driving time of the intermediate transfer belt 124 measured by the time measuring section 103 after the detection of the passage of the member position detecting section 1241, and stores the calculated position information and the background densities of the surface of the intermediate transfer belt 124 detected by the toner density detection sensors 23 and the density detecting section 101 at the positions indicated by the position information in the RAM 110 or the like while relating them to each other (S2, background density measuring step).

When the control unit 100 judges the arrival of the execution timing of the calibration process (S3; YES), the test patch formation controlling section 105 causes the image forming unit 12 to form test patches on the surface of the intermediate transfer belt 124 and causes developing bias voltage values at the time of forming the respective test patches to be stored in the RAM 110 (S4, test patch formation controlling step).

Subsequently, the toner density detection sensors 23 and the density detecting section 101 detect the toner densities of the respective test patches formed on the surface of the intermediate transfer belt 124. Further, the density correcting section 106 calculates the position information of the respective test patches by multiplying the driving time of the intermediate transfer belt 124 (driving time of the transfer belt drive motor 190) measured by the time measuring section 103 after the detection of the passage of the position detecting members 1241 by the position detecting member detection sensors 25 and the member position detecting sections 102 and the driving speed Vx (FIG. 2) of the intermediate transfer belt 124. The density correcting section 106 obtains the background densities corresponding to the calculated position information of the respective test patches from the RAM 110 or the like and calculates differences between the toner densities of the respective test patches detected by the toner density detection sensors 23 and the density detecting section 101 and the obtained background densities (S5). In other words, the appropriate densities of the test patches having the influence of the luminance of the surface of the intermediate transfer belt 124 and the like eliminated therefrom are calculated here.

Subsequently, the density correcting section 106 stores combinations of the calculated difference values between the densities of the respective test patches and the background densities and the developing bias voltage values stored in the RAM 110 at the time of forming the respective test patches in the RAM 110.

Subsequently, the density correcting section 106 plots points corresponding to the combinations of the developing bias voltage values and the difference values stored in the RAM 110 in a two-dimensional coordinate system as shown in FIG. 5 and calculates an approximation line minimizing the square sum of distances from the points corresponding to the respective combinations. Note that the toner density in FIG. 5 represents the difference values.

Then, the density correcting section 106 sets the developing bias voltage value on the approximation line corresponding to the target density set in the RAM 110 beforehand as a developing bias voltage value at the time of an image forming operation by the developing unit 121 (S6) and ends the calibration process. In other words, an example of a density correcting step according to the present invention is constituted by Steps S5 and S6 and the respective processes for realizing these Steps.

In the above flow, Step S2 is described to be performed at the time of the initialization process after the printer 1 is turned on, but is not limited to this and, for example, may be regularly performed after the elapse of a predetermined time or after a predetermined number of sheets are printed. Alternatively, furthermore printer 1 comprises a measurement timing receiving section for receiving an operation start timing of the background density measuring section 104 input from an operator, the process of Step S2 may be executed when the operation start timing of the background density measuring section 104 is received by the measurement timing receiving section. The operation unit 127 works as the measurement timing receiving section, according to the operation unit 127 accepts the operation start timing of the background density measuring section 104 from an operator by a touch panel function provided in the operation panel constituted by liquid crystal display or the like. With such an arrangement, a time actually required for the calibration process can be shortened by causing the background density measuring section 104 to store the background densities of the surface of the intermediate transfer belt 124 in the RAM 110 or the like before the calibration process by judging, for example, a situation where an image forming apparatus has been left unused for a long time.

Although the calibration process is described as a process for adjusting the developing bias voltage in the above embodiment, it is not limited to this. For example, the calibration process may be a process for adjusting image density at the time of another image forming operation such as the one for adjusting a drive voltage at the time of irradiating a laser beam by the charger 122 to form an electrostatic latent image for a toner image on the photoconductive drum 120 or the one for adjusting a density value in image data based on which an image is to be formed.

The construction and setting shown in FIGS. 1 to 6 are merely examples in the above embodiment and not restrictive. For example, although the color printer including the image generating units 12M, 12C, 12Y and 12Bk exclusively used for the respective colors is illustrated as an example of the image forming apparatus according to the present invention in the above embodiment, the image forming apparatus is not limited to this and may be a single-color printer, a multi-function peripheral provided with a scanner function, a facsimile function, a printer function and a copy function, or the like.

Conventionally, position detecting members are provided on an intermediate transfer belt to match background density measurement positions and test patch density measurement positions and, every time a calibration process is executed, the background densities are measured after the detection of the position detecting members is waited, test patches are formed at the same positions as the background density measurement positions after the detection of the position detecting members is waited again, and difference values between the test patch densities and the background densities are calculated.

However, in the present invention described above, the test patch formation controlling unit (test patch formation controlling step) causes test patches as toner images for density adjustment to be formed on the surface of the intermediate transfer member while causing the intermediate transfer member to be driven at the predetermined driving speed, and the density correcting unit (density correcting step) causes the calibration process to be executed to adjust image formation density by the image forming unit according to differences between the densities of the test patches and background densities corresponding to the position information on the formation positions of the test patches on the intermediate transfer member surface and stored in the memory unit by the background density measuring unit (background density measuring step).

Thus, in the present invention, even without successively measuring the background densities as densities of the surface of the intermediate transfer belt and the densities of the test patches after spending a long time to wait for the detection of the position detecting members every time the calibration process is executed, the densities of the test patches having the influence of the luminance of the intermediate transfer member surface in a state where no toner image is transferred eliminated therefrom can be quickly and accurately detected using the background densities corresponding to the position information of the formation positions of the test patches on the intermediate transfer member surface and stored in the memory unit by the background density measuring unit (background density measuring step), wherefore a time required for the calibration process can be shortened.

This application is based on Japanese Patent application No. 2010-103428 filed in Japan Patent Office on Apr. 28, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a memory unit;

an image forming unit that includes a photoconductive drum and a developing unit that supplies toner to the photoconductive drum and that forms a toner image on a circumferential surface of the photoconductive drum by applying a developing bias voltage to the developing unit;

an intermediate transfer member to which the toner image formed on the circumferential surface of the photoconductive drum is transferred and from which the toner image is secondarily transferred to a recording medium;

a density detecting unit that detects the density of a surface of the intermediate transfer member;

a background density measuring unit that stores background density, which is density of the intermediate transfer member surface detected by the density detecting unit in a state where the toner image is not transferred, in the memory unit in correspondence with position information on the intermediate transfer member surface before an execution timing of a calibration process that adjusts image formation density, separately from the calibration process;

a test patch formation controlling unit that causes the image forming unit to form a test patch, which is a toner image for density adjustment, on the intermediate transfer member surface while causing the intermediate transfer member to drive at a predetermined driving speed;

a density correcting unit that executes the calibration process, after the background density has been stored in the memory unit in correspondence with the position information by the background density measuring unit and after a predetermined number of sheets are printed by the image forming apparatus;

a member position detecting unit that detects the passage of a position detecting member provided on the intermediate transfer member surface; and a time measuring unit that measures a driving time of the intermediate transfer member after the detection of the passage of the position detecting member by the member position detecting unit;

wherein the density correcting unit adjusts image formation density by the image forming unit according to a difference between the background density already stored in the memory unit and corresponding to the position information indicating the formation position of the test patch on the intermediate transfer member surface and the density of the test patch formed on the intermediate transfer member surface by the test patch formation controlling unit and detected by the density detecting unit at the time of executing the calibration process, the density correcting unit sets a developing bias voltage value which is a value of the developing bias voltage according to the difference to adjust the image formation density, the density correcting unit executes the calibration process using the background density stored in the memory unit without measuring the background density by the background density measuring unit every time the calibration process is started, the background density measuring unit stores a multiplication result of the driving time of the intermediate transfer member measured by the time measuring unit after the detection of the passage of the position detecting member and the predetermined driving speed of the intermediate transfer member as position information indicating a position on the intermediate transfer member surface in a moving direction of the intermediate transfer member surface in the memory unit in correspondence with the background density, the test patch formation controlling unit causes the image forming unit to form a plurality of the test patches on the intermediate transfer member surface, the density correcting unit calculates the position information indicating the position on the intermediate transfer member surface for the respective plurality of test patches formed by the image forming unit by multiplying the driving time of the intermediate transfer member measured by the time measuring unit after the detection of the passage of the position detecting member and the predetermined driving speed of the intermediate transfer member, the density correcting unit plots points corresponding to combinations of the developing bias voltage values at the time of forming the respective plurality of test patches and the difference values between densities of the plurality of test patches and the background densities in a two-dimensional coordinate system, and calculates an approximation line representing a relation between the developing bias voltage values and toner densities by using the points, and the density correcting unit obtains a target developing bias voltage value corresponding to a target density set beforehand based on the approximation line, and sets the target developing bias voltage value as the developing bias voltage value at the time of an image forming operation by the developing unit.

2. An image forming apparatus according to claim 1, further comprising a measurement timing receiving unit that receives a timing, at which the background density as the density of the intermediate transfer member surface detected by the density detecting unit becomes stored in the memory unit by the background density measuring unit in correspondence with the position information on the intermediate transfer member surface, based on an input instruction from an operator.

3. A density adjusting method that adjusts image formation density by an image forming unit in an image forming apparatus including a memory unit, the image forming unit including a photoconductive drum and a developing unit that supplies toner to the photoconductive drum and that forms a toner image on a circumferential surface of the photoconductive drum by applying a developing bias voltage to the developing unit, an intermediate transfer member to which the toner image formed on the circumferential surface of the photoconductive drum is transferred and from which the toner image is secondarily transferred to a recording medium, and a density detecting unit that detects the density of a surface of the intermediate transfer member, comprising:

a background density measuring step of storing background density, which is density of the intermediate transfer member surface detected by the density detecting unit in a state where the toner image is not transferred, in the memory unit in correspondence with position information on the intermediate transfer member surface before an execution timing of a calibration process that adjusts the image formation density separately from the calibration process;

a test patch formation controlling step of causing the image forming unit to form a test patch, which is a toner image for density adjustment, on the intermediate transfer member surface while causing the intermediate transfer member to drive at a predetermined driving speed;

a density correcting step of executing the calibration process, after the background density has been stored in the memory unit in correspondence with the position information by the background density measuring step and after a predetermined number of sheets are printed by the image forming apparatus;

a member position detecting step of detecting the passage of a position detecting member provided on the intermediate transfer member surface; and a time measuring step of measuring a driving time of the intermediate transfer member after the detection of the passage of the position detecting member by the member position detecting step;

wherein the density correcting step includes adjusting the image formation density by the image forming unit according to a difference between the background density already stored in the memory unit and corresponding to the position information indicating the formation position of the test patch on the intermediate transfer member surface and the density of the test patch formed on the intermediate transfer member surface in the test patch formation controlling step and detected by the density detecting unit at the time of executing the calibration process, the density correcting step includes setting a developing bias voltage value that is a value of the developing bias voltage according to the difference to adjust the image formation density, the density correcting step of executing the calibration process uses the background density stored in the memory unit without measuring the background density by the background density measuring step every time the calibration process is executed the background density measuring step includes storing a multiplication result of the driving time of the intermediate transfer member measured by the time measuring step after the detection of the passage of the position detecting member and the predetermined driving speed of the intermediate transfer member as position information indicating a position on the intermediate transfer member surface in a moving direction of the intermediate transfer member surface in the memory unit in correspondence with the background density, the test patch formation controlling step includes causing the image forming unit to form a plurality of the test patches on the intermediate transfer member surface, the density correcting step includes calculating the position information indicating the position on the intermediate transfer member surface for the respective plurality of test patches formed by the image forming unit by multiplying the driving time of the intermediate transfer member measured by the time measuring step after the detection of the passage of the position detecting member and the predetermined driving speed of the intermediate transfer member, the density correcting step includes plotting points corresponding to combinations of the developing bias voltage values at the time of forming the respective plurality of test patches and the difference values between densities of the plurality of test patches and the background densities in a two-dimensional coordinate system, and calculates an approximation line representing a relation between the developing bias voltage values and toner densities by using the points, and the density correcting step includes obtaining a target developing bias voltage value corresponding to a target density set beforehand based on the approximation line, and sets the target developing bias voltage value as the developing bias voltage value at the time of an image forming operation by the developing unit.

* * * * *